US006135591A

United States Patent [19]

Ikeda et al.

[11] Patent Number: 6,135,591

[45] Date of Patent: Oct. 24, 2000

[54] IMAGE FORMING APPARATUS CONTROLLING DISCHARGE DIRECTION OF RECORDING MEDIUM

[75] Inventors: Kunihiko Ikeda, Kodaira; Kaneji Yamada, Kawasaki, both of Japan

[73] Assignee: Canon Kabushiki Kaisha, Tokyo, Japan

[21] Appl. No.: 08/932,916

[22] Filed: Sep. 18, 1997

[30] Foreign Application Priority Data

Sep. 24, 1996 [JP] Japan ..... 8-251621

[51] Int. Cl.[7] ..... B41J 2/01; B65H 29/00; G03G 15/00

[52] U.S. Cl. ..... 347/104; 271/184; 347/105; 399/405

[58] Field of Search ..... 271/3.01, 3.03, 271/3.12, 161, 184, 225, 230; 347/101, 104, 105, 107; 399/315, 316, 317, 361, 364, 372, 373, 374, 375, 397, 399, 404, 405, 406, 394

[56] References Cited

U.S. PATENT DOCUMENTS 5,532,811 7/1996 Nishikawa et al. ..... 399/384
5,805,176 9/1998 Saito et al. ..... 347/8

FOREIGN PATENT DOCUMENTS 6-274056 9/1994 Japan .

*Primary Examiner*—Arthur T. Grimley
*Assistant Examiner*—Hoang Ngo
*Attorney, Agent, or Firm*—Fitzpatrick, Cella, Harper & Scinto

[57] ABSTRACT

When discharging a sheet material from an image forming apparatus after completion of image formation, at least one spur roller for discharging the trailing edge of the sheet material downward is provided. Hence, it is possible to more stably discharge the sheet material than ever, and to arrange and mount sheets of the sheet material on a discharged-sheet tray in a manner better than ever.

24 Claims, 6 Drawing Sheets

IMAGE FORMING APPARATUS CONTROLLING DISCHARGE DIRECTION OF RECORDING MEDIUM

BACKGROUND OF THE INVENTION

1. Field of the Invention

This invention relates to a sheet-material discharging mechanism in an image forming apparatus for forming an image on a sheet material.

2. Description of the Related Art

Each of conventional image forming apparatuses for performing recording on a sheet material includes a discharging mechanism for discharging the sheet material after the recording to the outside of the apparatus.

FIG. 6 is a diagram illustrating the configuration of such a conventional discharging mechanism.

The mechanism shown in FIG. 6 relates to an ink-jet recording apparatus. In FIG. 6, a sheet material 4 is fed from a sheet feeding device 3 to sheet conveying rollers 6 and 7 by a sheet feeding roller 5. An image is formed on the sheet material 4 by a recording head 1, and the sheet material 4 having the image thereon is fed to a portion between a sheet discharging roller 10 and a spur roller 11.

Since the spur roller 11 has the shape of a spur, it has the function of discharging the sheet material 4 to the outside of the apparatus while pressing it against the sheet discharging roller 10 without disturbing the recorded image even if the spur roller 11 rubs the image in a state of rotatably contacting the image.

The spur roller 11 is disposed with an angle $\alpha$ with respect to the sheet discharging roller 10 so that the leading edge of the sheet material 4 is slightly raised when the sheet material 4 is discharged. It is thereby possible to press the sheet material 4 against the surface of a platen 8 in order to maintain the distance between the sheet material 4 and the recording head 1 constant. Furthermore, It is possible to increase the time period from discharge to landing of the sheet material 4 in order to sufficiently dry ink on the preceding sheet material 4.

The discharged sheet material 4 is mounted on a discharged-sheet tray 17 provided outside the apparatus.

When the surface of the discharged sheet material 4 is very smooth, the following problems arise. For example, a discharged sheet of the sheet material 4 slides over the previously mounted sheet to a position beyond a predetermined position, thereby disturbing mounting of sheets of the sheet material 4. If recording is performed on a desk, a discharged sheet of the sheet material 4 drops onto the floor passing through the discharged-sheet tray 17, so that the recorded image on the sheet is stained.

Conventionally, in order to solve the above-described problems, when discharging the sheet material 4 having a recorded image thereon by the sheet discharging roller 10, the speed of discharge of the sheet material 4 is reduced by reducing the rotational speed of the sheet discharging roller 10 or stopping the rotation of the sheet discharging roller 10 immediately after discharge of the sheet in order to prevent the sheet material 4 from passing through the discharged-sheet tray 17 to the outside of the apparatus and thereby to improve the mountability of the sheet material 4. In such a case, however, a case in which the trailing edge of the sheet material 4 remains on the sheet discharging roller 10 may arise. If an operation of inverting the direction of rotation of the sheet discharging roller 10 is performed (which may arise in an initial operation when starting sheet feeding), the sheet material 4 may be drawn backward to cause a jam.

SUMMARY OF THE INVENTION

It is an object of the present invention to provide a sheet-material disharging mechanism for preventing a sheet material from being discharged passing through a discharged-sheet tray as much as possible and for stably and regularly mounting sheets of the sheet material on the discharged-sheet tray.

According to one aspect, the present invention, which achieves the above-described object, relates to an image forming apparatus including image forming means for forming an image on a sheet material by discharging ink droplets thereon, and a pair of rotating members for discharging the sheet material on which the image has been formed by the image forming means. A direction of discharge of a portion including the trailing edge of the sheet material is changed to downward by moving the position of one of the pair of rotating members.

According to another aspect, the present invention, which achieves the above-described object, relates to an image forming apparatus including image forming means for forming an image on a sheet material by discharging ink droplets thereon, and a discharging roller for discharging the sheet material on which the image has been formed by the image forming means. At least one spur roller engaged with the discharging roller is provided for the discharging roller. A direction of discharge of a portion near the trailing edge of the sheet material is changed from upward to downward by moving the position of the spur roller.

According to still another aspect, the present invention, which achieves the above-described object, relates to an image forming apparatus including image forming means for forming an image on a sheet material by discharging ink droplets thereon, and a discharging roller for discharging the sheet material on which the image has been formed by the image forming means. An engaging roller engaged with the discharging roller, and a spur roller vertically moving at a portion closer to a discharging port than the engaging roller are provided for the discharging roller. A direction of discharge of a portion near the trailing edge of the sheet material is changed from upward to downward by moving the spur roller from an upper position to a lower position.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 4(*b*) is a diagram illustrating the configuration of a spur roller shown in FIG. 4(*a*);

DETAILED DESCRIPTION OF THE PREFERRED EMBODIMENTS

Figure 1:
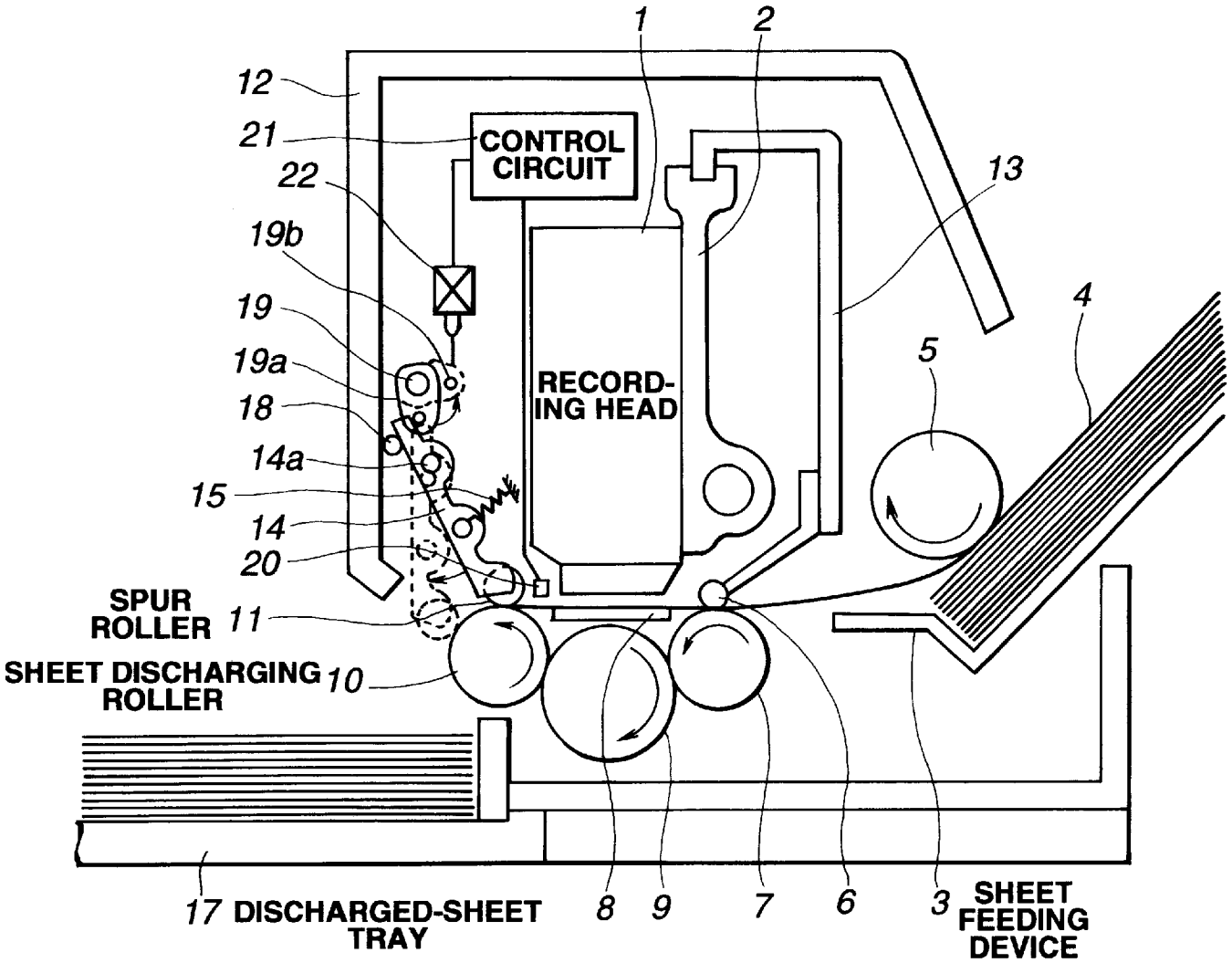
FIG. 1 is a diagram illustrating the configuration of an image forming apparatus according to a first embodiment of the present invention.

FIG. 1 is a diagram illustrating the configuration of an image forming apparatus according to a first embodiment of the present invention.

In FIG. 1, a recording head 1 is mounted on a carriage 2 moving in a main scanning direction of recording. Sheets of a sheet material 4 are mounted on a sheet feeding device 3, and are sequentially fed from the uppermost sheet by a sheet feeding roller 5. Sheet conveying rollers 6 and 7 rotate while grasping the fed sheet 4 therebetween to transfer the sheet 4 to a recording side at a predetermined pitch.

When the sheet 4 passes over a platen 8, recording by the recording head 1 is performed. The rotation of the sheet conveying roller 7 is transmitted to a sheet discharging roller 10 via a transmission roller 9. The sheet discharging roller 10 discharges the sheet 4 having an image recorded thereon to the outside of the apparatus in cooperation with spur rollers 11 engaged with the sheet feeding roller 10 thereabove. Reference numeral 12 represents a main-body case of the apparatus, and reference numeral 13 represents a chassis.

Figure 2:
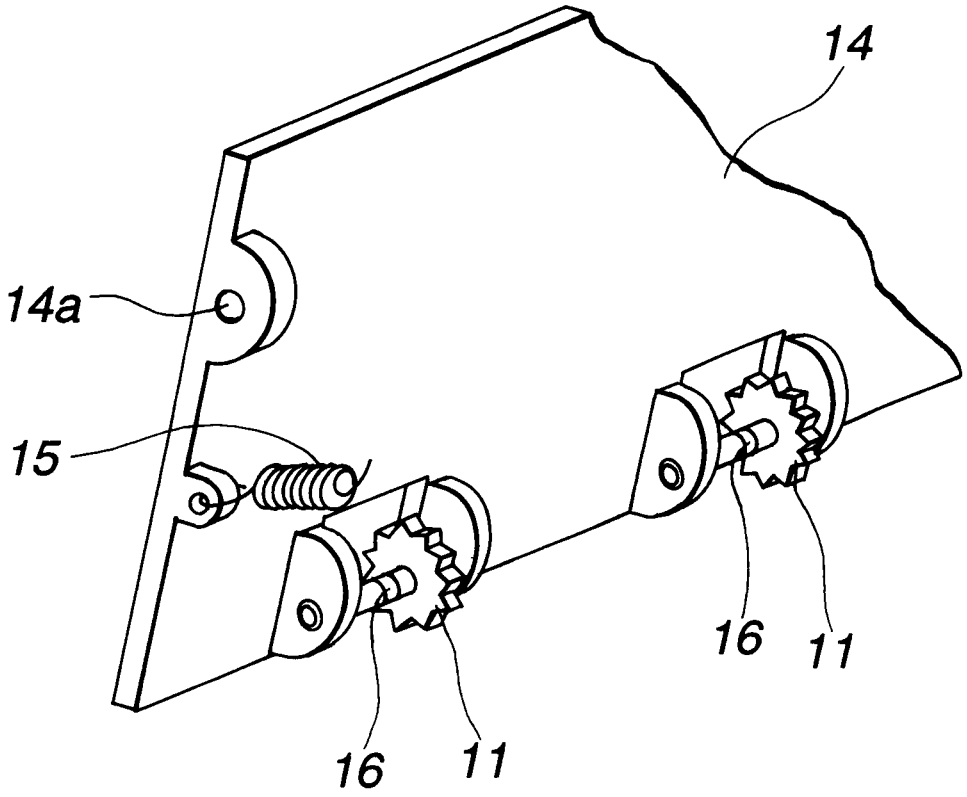
FIG. 2 is a diagram illustrating the configuration of spur rollers shown in FIG. 1.

Next, a description will be provided of the configuration of the spur rollers 11 constituting a sheet discharging device of the apparatus with reference to FIG. 2.

A plurality of spur rollers 11 are held on corresponding spring shafts 16 provided on a spur-roller holder 14. The spring shaft 16 comprises a coil spring. Hence, the spur roller 11 can move between an upper position and a lower position. Usually, the spur rollers 11 are pressed against the sheet discharging roller 10 by the pressing force of the spring shafts 16.

In FIG. 1, in a state indicated by solid lines, the sheet discharging roller 10 and the spur rollers 11 are disposed so as to discharge the sheet 4 in a state in which the leading edge of the sheet 4 is slightly upward when the leading edge of the sheet 4 passes through a portion between the sheet discharging roller 10 and the spur rollers 11.

As shown in FIGS. 1 and 2, the spur-roller holder 14 is swingably held on the main-body case 12 at a bearing portion 14*a*, and is usually maintained at the position indicated by the solid lines shown in FIG. 1 by a spring 15. Reference numeral 17 represents a discharged-sheet tray which is drawn out of the apparatus. The discharged-sheet tray 17 is retracted in a lower portion of the apparatus when it is not used. There are also shown stoppers 18 and 19*b* for the spur-roller holder 14. The stopper 18 maintains the spur roller 11 at an initial position.

When a sheet-end sensor 20 detects the trailing edge of the sheet 4, a control circuit 21 moves a cam 19*a* supported on a rotation shaft 19 in the direction of an arrow shown in FIG. 1 by driving a solenoid 22. According to this configuration, upon completion of recording on the sheet 4 by the recording head 1, the rotation shaft 19 rotates to raise the cam 19*a* and the stopper 19*b*, which is a pin fixed on the cam 19*a*, to a position indicated by broken lines.

Figures 3A, 3B, 3C:
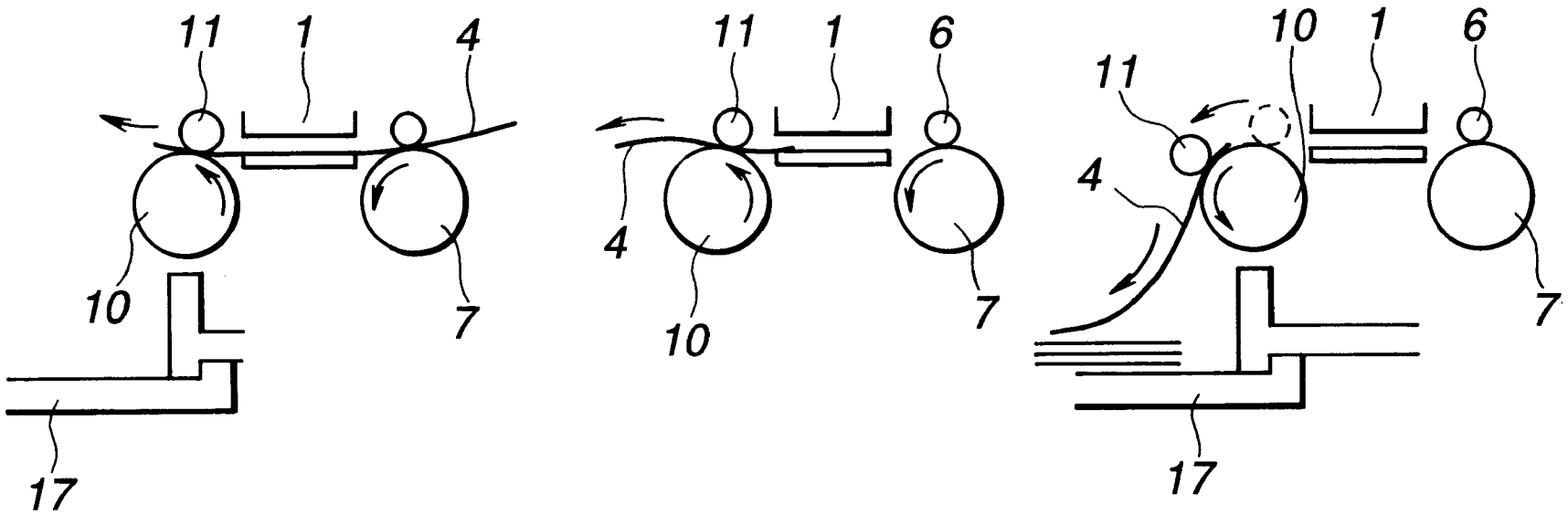
FIGS. 3(*a*) through 3(*c*) are diagrams illustrating a sheet discharging operation in the first embodiment.

Next, a description will be provided of the operation of the first embodiment with reference to FIGS. 3(*a*) through 3(*c*).

In FIG. 3(*a*), the sheet 4 on which recording has been performed by the recording head 1 is fed and enters between the sheet discharging roller 10 and the spur roller 11. The spur roller 11 is provided in the vicinity of the recording head 1 (the position indicated by the solid lines in FIG. 1) so as to draw the leading edge of the sheet 4 as early as possible in order to prevent the sheet 4 from contacting the recording head 1 due to raising of the sheet 4 during recording and to maintain the distance between the recording head 1 and the sheet 4 during recording at a predetermined value. At that time, as shown in FIG. 1, the spur-roller holder 14 is held by the spring 15 so as to position the spur roller 11 in the vicinity of the recording head 1.

Then, as shown in FIG. 3(*b*), when the trailing edge of the sheet 4 leaves a position under the recording head 1, the stopper 19*b* disengages the spur-roller holder 14, so that the spur roller 11 rotatably moves on the sheet discharging roller 10 together with the sheet 4 while pressing the trailing edge of the sheet 4.

The spur roller 11 presses the trailing edge of the sheet 4 until the trailing edge of the sheet 4 passes through the spur roller 11 and the sheet discharging roller 10, as shown in FIG. 3(*c*). Hence, the sheet 4 drops onto the discharged-sheet tray 17 without being energized to travel forward. At that time, since the sheet discharging roller 10 is still rotating, the sheet 4 assuredly drops onto the discharged-sheet tray 17.

When the rotation of the sheet discharging roller 10 stops upon completion of discharge of the sheet 4, the spur-roller holder 14 holding the spur roller 11 is returned to the initial position by the spring 15, and the stopper 19*b* descends to the initial position to prevent the movement of the spur roller 11 during recording.

By thus placing the spur roller 11 at the position shown in FIGS. 3(*a*) and 3(*b*) in an upward state while it contacts a portion between the leading edge and a portion near the trailing edge of the sheet 4, and placing the spur roller 11 at the position shown in FIG. 3(*c*) in a downward state while it contacts a portion near the training edge of the sheet 4, it is possible to change the direction of discharge of the sheet 4 from upward to downward at the portion near the trailing edge of the sheet 4.

As described above, it is possible to stably and regularly mount sheets of the sheet material 4 fed after recording on the discharged-sheet tray 17.

Figure 4B:
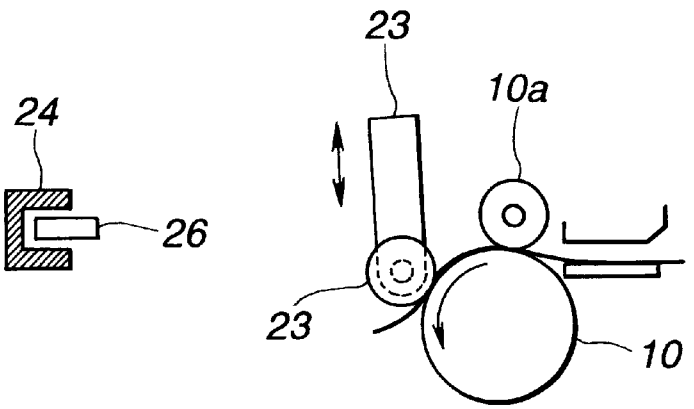
FIG. 4(*a*) is a diagram illustrating the configuration of an image forming apparatus according to a second embodiment of the present invention.
Figure 4A:
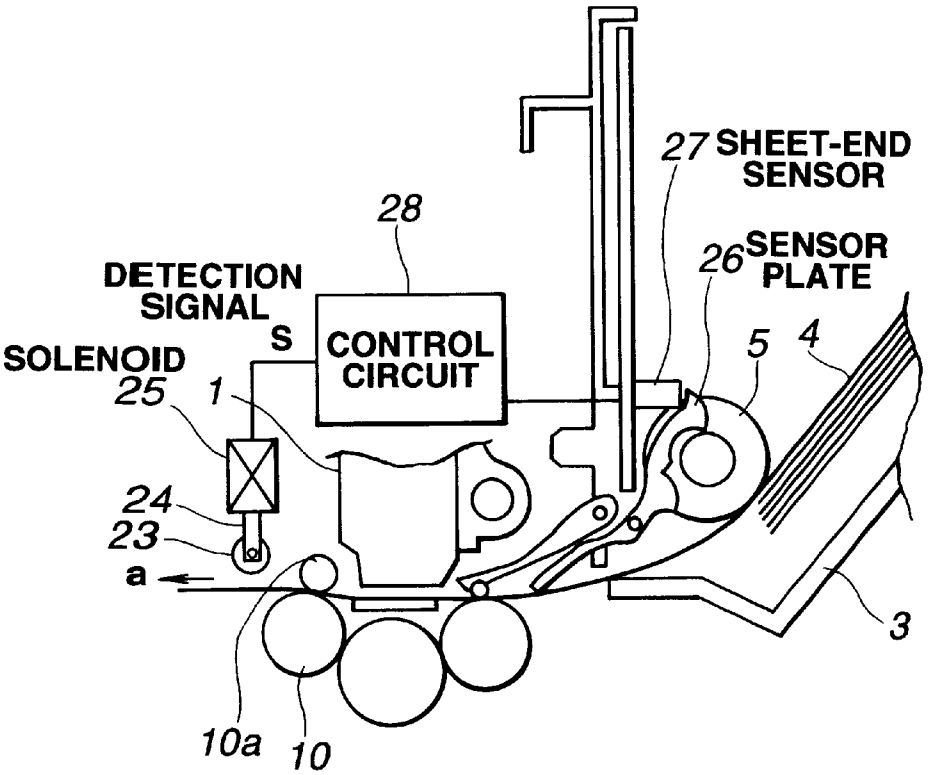

FIGS. 4(*a*) and 4(*b*) are diagrams illustrating the configuration of a second embodiment of the present invention. In FIGS. 4(*a*) and 4(*b*), reference numeral 23 represents a spur roller, and reference numeral 10*a* represents an engaging roller.

Briefly speaking, the second embodiment is configured such that, when the passage of the leading edge of a sheet 4 through a sensor plate 26 has been detected, the spur roller 23 is placed above the sheet 4 moving in a direction of discharge "a", and when the passage of the trailing edge of the sheet 4 through the sensor plate 26 has been detected, the spur roller 23 is dropped onto the sheet 4.

After the lapse of a predetermined time period after detection of the trailing edge of the sheet 4 by the sensor plate 26 and a sheet-end sensor 27, a solenoid 25 operates a spur-roller holder 24 in response to a detection signal S from a control circuit 28, to vertically move the spur roller 23.

Figure 5A:
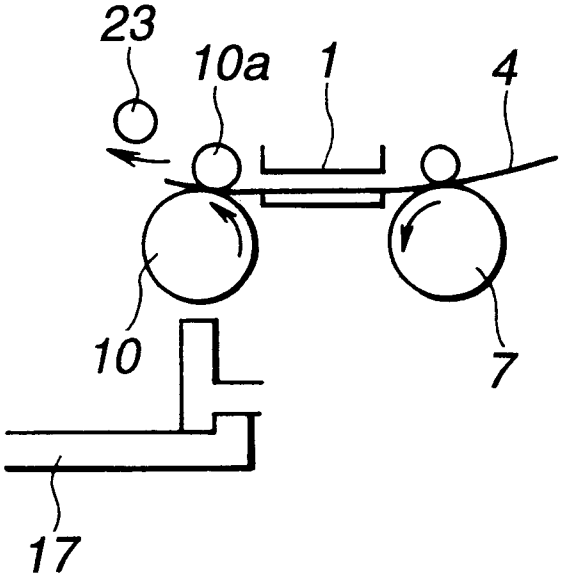
FIGS. 5(*a*) through 5(*c*) are diagrams illustrating a sheet discharging operation in the second embodiment.
Figure 5B:
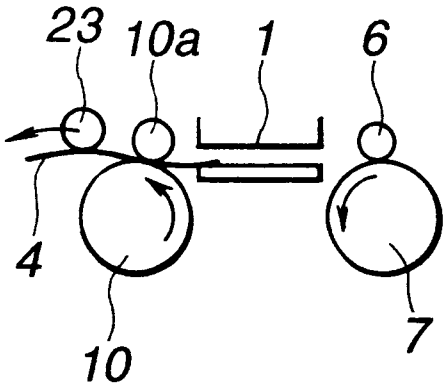
Figure 5C:
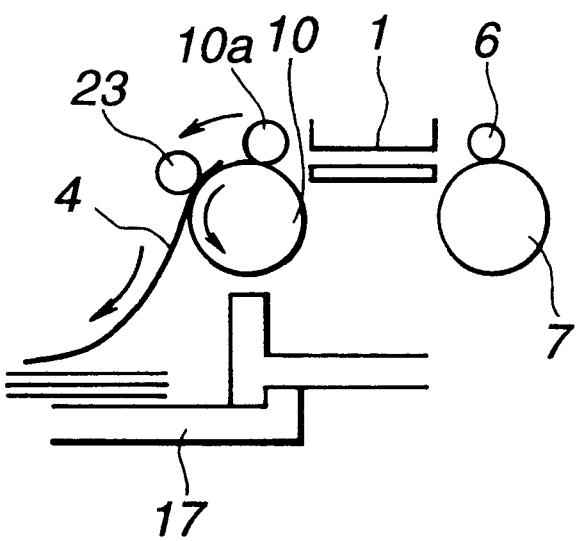
Figure 6:
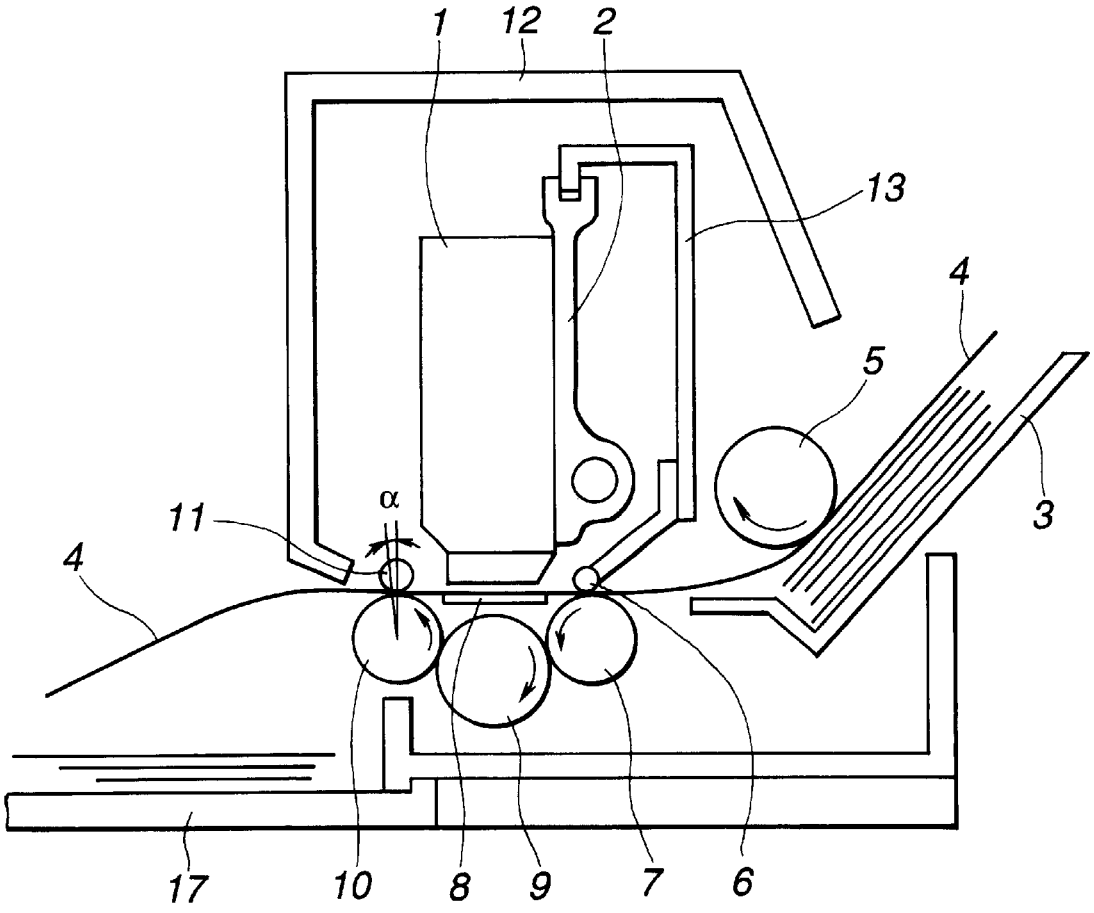
FIG. 6 is a diagram illustrating the configuration of a conventional sheet discharging device used in an image forming apparatus.

Next, a description will be provided of the operation of the second embodiment with reference to FIGS. 5(*a*) through 5(*c*).

In FIG. 5(*a*), the sheet 4 on which recording has been performed by a recording head 1 is fed and enters between a sheet discharging roller 10 and an engaging roller 10*a*. The engaging roller 10*a* is provided in the vicinity of the recording head 1 so as to prevent the sheet 4 from contacting the recording head 1 due to raise of the sheet 4 during recording and to maintain the distance between the recording head 1 and the sheet 4 during recording at a predetermined value. The engaging roller 10*a* may comprise a spur roller.

The operation of the sheet 4 up to this time is the same as in the first embodiment. At that time, the spur roller 23 is held at an upper position by the solenoid 25.

Then, as shown in FIG. 5(*b*), when the trailing edge of the sheet 4 leaves a position under the recording head 1, the spur roller 23 is moved to a lower position by the solenoid 25, and rotatably moves on the sheet discharging roller 10 together with the sheet 4 while pressing the trailing edge of the sheet 4.

The spur roller 11 presses the trailing edge of the sheet 4 until the trailing edge of the sheet 4 passes through the spur roller 23 and the sheet discharging roller 10, as shown in FIG. 5(*c*). Hence, the sheet 4 drops onto a discharged-sheet tray 17 without being energized to travel forward. At that time, since the sheet discharging roller 10 is still rotating, the sheet 4 assuredly drops onto the discharged-sheet tray 17.

When the rotation of the sheet discharging roller 10 stops upon completion of discharge of the sheet 4, the spur-roller holder 24 holding the spur roller 23 is returned to the initial position by the solenoid 25 to prevent the movement of the spur roller 23 during recording.

As described above, according to the present invention, when discharging a sheet material after completion of image formation, a spur roller for discharging the trailing edge of the sheet material downward is provided. Hence, it is possible to more stably discharge the sheet material than ever, and to arrange and mount sheets of the sheet material on a discharged-sheet tray in a manner better than ever.

The individual components shown in outline in the drawings are all well-known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

image forming means for forming an image on a sheet material;

a pair of rotating members for discharging the sheet material on which the image is formed by said image forming means; and moving means for moving the position of one of said pair of rotating members to change a direction of discharge of a portion near the trailing edge of the sheet material to downward.

2. An image forming apparatus according to claim 1, wherein the one of said pair of rotating members comprises a spur-shaped rotating member.

3. An image forming apparatus according to claim 1, wherein the one of said pair of rotating members is movable between an upper position and a lower position and a recording portion of the sheet material is maintained a predetermined distance from said image forming means when the one of said pair of rotating members is in the upper position.

4. An image forming apparatus according to claim 1, further comprising a discharge tray, wherein the one of said pair of rotating members is movable between an upper position and a lower position and the sheet material is guided to said discharge tray when the one of said pair of rotating members is in the lower position.

5. An image forming apparatus according to claim 1, wherein said moving means comprises an actuator for moving the one of said pair of rotating members.

6. An image forming apparatus according to claim 5, further comprising a sensor for detecting the trailing edge of the sheet material, wherein said actuator causes said one of said pair of rotating members to move vertically downward after said sensor senses the trailing edge of the sheet material.

7. An image forming apparatus comprising:

image forming means for forming an image on a sheet material by discharging ink droplets thereon; and a discharging roller for discharging the sheet material on which the image has been formed by said image forming means, wherein at least one spur roller engaged with said discharging roller is provided for said discharging roller, and wherein a direction of discharge of a portion near the trailing edge of the sheet material is changed from upward to downward by moving the position of said at least one spur roller.

8. An image forming apparatus according to claim 7, wherein a plurality of spur rollers are engaged with said discharging roller.

9. An image forming apparatus according to claim 8, wherein said plurality of spur rollers are provided on a holder member, which is swingable with respect to a main body of said apparatus.

10. An image forming apparatus according to claim 9, wherein said holder member is swingable with respect to the main body of said apparatus by means of a spring member.

11. An image forming apparatus according to claim 7, wherein a supporting shaft of said at least one spur roller comprises a coil spring.

12. An image forming apparatus according to claim 3, further comprising an actuator for moving said at least one spur roller.

13. An image forming apparatus according to claim 12, further comprising a sensor for detecting the trailing edge of the sheet material, wherein said actuator causes said at least one spur roller to move downward after said sensor senses the trailing edge of the sheet material.

14. An image forming apparatus according to claim 7, wherein said at least one spur roller is movable between an upper position and a lower position and when said at least one spur roller is in the upper position, a recording portion of the sheet material is maintained a predetermined distance from said image forming means.

15. An image forming apparatus according to claim 7, further comprising a discharge tray, wherein said at least one spur roller is movable between an upper position and a lower position and the sheet material is guided to said discharge tray when said at least one spur roller is in the lower position.

16. An image forming apparatus comprising:

image forming means for forming an image on a sheet material by discharging ink droplets thereon; and a discharging roller for discharging the sheet material, on which the image has been formed by said image forming means, through a discharge port, wherein an engaging roller engaged with said discharging roller, and a spur roller vertically moving at a portion closer to the discharging port than said engaging roller are provided for said discharging roller, and wherein a direction of discharge of a portion near the trailing edge of the sheet material is changed from upward to downward by moving said spur roller from an upper position to a lower position.

17. An image forming apparatus according to claim 16, wherein a plurality of spur rollers are engaged with said discharging roller.

18. An image forming apparatus according to claim 17, wherein said plurality of spur rollers are provided on a holder member.

19. An image forming apparatus according to claim 16, wherein a supporting shaft of said spur roller comprises a coil spring.

20. An image forming apparatus according to claim 16, wherein said engaging roller comprises a spur roller.

21. An image forming apparatus according to claim 16, further comprising an actuator for vertically moving said spur roller.

22. An image forming apparatus according to claim 21, further comprising a sensor for detecting the trailing edge of the sheet material, wherein said actuator causes said spur roller to move vertically downward after said sensor senses the trailing edge of the sheet material.

23. An image forming apparatus according to claim 16, wherein when said spur roller is in the upper position, a recording portion of the sheet material is maintained a predetermined distance from said image forming means.

24. An image forming apparatus according to claim 16, further comprising a discharge tray, wherein the sheet material is guided to said discharge tray when said spur roller is in the lower position.

* * * * *